US010041313B2

(12) United States Patent
Miller et al.

(10) Patent No.: US 10,041,313 B2
(45) Date of Patent: Aug. 7, 2018

(54) METHOD AND SYSTEM FOR EXTENDING REACH IN DEVIATED WELLBORES USING SELECTED INJECTION SPEED

(71) Applicants: SCHLUMBERGER TECHNOLOGY CORPORATION, Sugar Land, TX (US); MASSACHUSETTS INSTITUTE OF TECHNOLOGY, Cambridge, MA (US)

(72) Inventors: James Miller, Boston, MA (US); Nathan Wicks, Somerville, MA (US); Pedro Reis, Cambridge, MA (US); Tianxiang Su, Somerville, MA (US)

(73) Assignees: SCHLUMBERGER TECHNOLOGY CORPORATION, Sugar Land, TX (US); MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 435 days.

(21) Appl. No.: 14/567,589

(22) Filed: Dec. 11, 2014

(65) Prior Publication Data

US 2015/0159447 A1 Jun. 11, 2015

Related U.S. Application Data

(60) Provisional application No. 61/914,469, filed on Dec. 11, 2013.

(51) Int. Cl.
*E21B 19/22* (2006.01)
*E21B 41/00* (2006.01)
(Continued)

(52) U.S. Cl.
CPC ..... *E21B 19/22* (2013.01); *E21B 7/24* (2013.01); *E21B 28/00* (2013.01); *E21B 31/005* (2013.01); *E21B 41/00* (2013.01)

(58) Field of Classification Search
CPC ..... E21B 31/005; E21B 19/22; E21B 19/02; E21B 28/00; E21B 41/00; E21B 17/20;
(Continued)

(56) References Cited

U.S. PATENT DOCUMENTS 6,439,318 B1 8/2002 Eddison et al.
6,907,927 B2 6/2005 Zheng et al.
(Continued)

FOREIGN PATENT DOCUMENTS

WO 2012161595 A1 11/2012

OTHER PUBLICATIONS

Castaneda et al., "Coiled Tubing Milling Operations: Successful Application of an Innovative Variable-Water Hammer Extended-Reach BHA to Improve End Load Efficiencies of a PDM in Horizontal Wells", 2011, 143346-MS SPE Conference Paper, 19 pages.
(Continued)

*Primary Examiner* — George S Gray

(57) ABSTRACT

A method for extending reach of a coiled tubing string in a deviated wellbore includes vibrating the tubing string while the tubing string is injected into the wellbore at a first injection speed, finding the peak speed of lateral vibration of the tubing string, determining a second injection speed as a function of the obtained peak speed of lateral vibration, and adjusting the injection speed of the vibrating tubing string from the first injection speed to the determined second injection speed based on said function. A non-transitory computer-readable storage medium to execute the foregoing method is provided, along with a system for extending reach of a coiled tubing string in a deviated wellbore.

20 Claims, 6 Drawing Sheets

(51) Int. Cl.

| | |
|---|---|
| ***E21B 7/24*** | (2006.01) |
| ***E21B 31/00*** | (2006.01) |
| ***E21B 28/00*** | (2006.01) |

(58) Field of Classification Search

CPC ..... E21B 7/024; E21B 7/20; G05D 19/02; G01H 1/00–1/16

USPC ..... 166/242.2, 77.2, 77.1, 384, 385

See application file for complete search history.

(56) References Cited

U.S. PATENT DOCUMENTS

| | | | | |
|---|---|---|---|---|
| 7,757,783 | B2 | 7/2010 | Pfahlert | |
| 2004/0055744 | A1 | 3/2004 | Zheng | |
| 2006/0065440 | A1 | 3/2006 | Hutchinson | |
| 2011/0203395 | A1 | 8/2011 | Pfahlert | |
| 2013/0049981 | A1* | 2/2013 | MacPherson | E21B 44/00 340/853.1 |
| 2013/0186619 | A1 | 7/2013 | Wicks et al. | |
| 2013/0186686 | A1 | 7/2013 | Heisig | |
| 2013/0246029 | A1 | 9/2013 | Wicks et al. | |
| 2014/0196952 | A1* | 7/2014 | Schicker | E21B 7/24 175/56 |
| 2015/0193126 | A1 | 7/2015 | Whalley | |

OTHER PUBLICATIONS

Sola, et al., "New Downhole Tool for Coiled Tubing Extended Reach", 2000, 60701-MS SPE Conference Paper, 8 pages.

Robertson, et al., "Dynamic Excitation Tool: Developmental Testing and CTD Field Case Histories", SPE/ICoTA Coiled Tubing Conference and Exhibition, Mar. 23-24, 2004, SPE 89519, 16 pages.

Wicks, Nathan, et al., "Horizontal Cylinder-in-Cylinder Buckling Under Compression and Torsion: Review and Application to Composite Drill Pipe," International Journal of Mechanical Sciences 50 (2008) pp. 538-549.

* cited by examiner

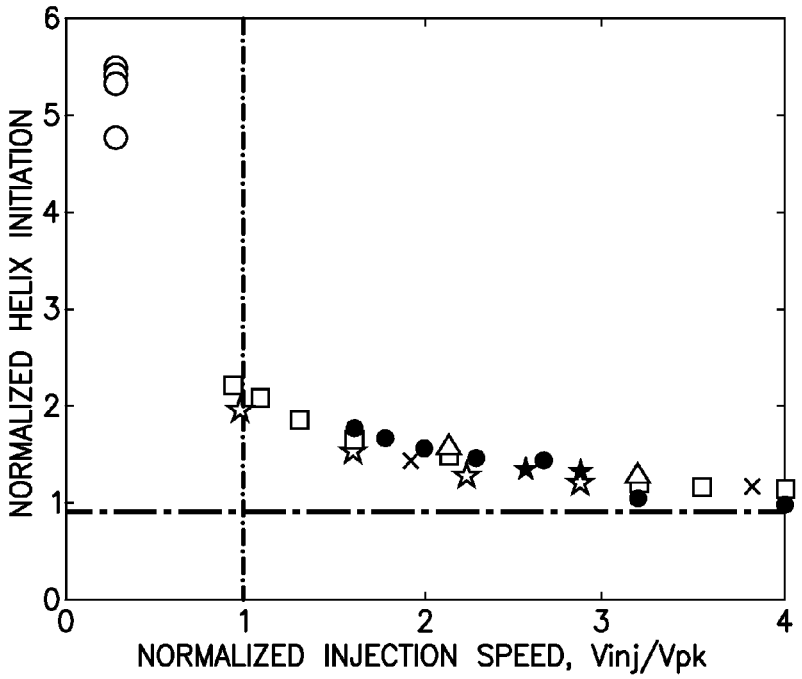

| | | | |
|---|---|---|---|
| □ | FIXED FREQUENCY f=100Hz | Vinj=0.1m/s | CHANGING PEAK ACCELERATION |
| ● | FIXED FREQUENCY f=50Hz | Vinj=0.1m/s | CHANGING PEAK ACCELERATION |
| △ | FIXED FREQUENCY f=200Hz | Vinj=0.1m/s | CHANGING PEAK ACCELERATION |
| × | FIXED FREQUENCY f=100Hz | PEAK ACCELERATION=2g | CHANGING INJECTION SPEED |
| ☆ | FIXED PEAK ACCELERATION GAMMA=2g | Vinj=0.1m/s | CHANGING FREQUENCY |
| ★ | FIXED PEAK ACCELERATION GAMMA=2g | Vinj=0.1m/s | CHANGING FREQUENCY |
| ○ | FIXED PEAK ACCELERATION GAMMA=1.75g | CHANGING INJECTION SPEED | CHANGING FREQUENCY |

FIG.4

METHOD AND SYSTEM FOR EXTENDING REACH IN DEVIATED WELLBORES USING SELECTED INJECTION SPEED

CROSS-REFERENCE TO RELATED APPLICATIONS

The present application claims priority under 35 U.S.C. § 119(e) to Provisional Application Ser. No. 61/914,469, filed on Dec. 11, 2013 and entitled "METHOD FOR EXTENDING REACH IN DEVIATED WELLBORES," which is hereby incorporated by reference herein in its entirety.

TECHNICAL FIELD

The subject disclosure relates to the hydrocarbon industry. More particularly, the subject disclosure relates to a method for extending reach in deviated wellbores.

BACKGROUND

Coiled tubing refers to metal piping, used for interventions in oil and gas wells and sometimes as production tubing in depleted gas wells. Coiled tubing operations typically involve at least three primary components. The coiled tubing itself is spooled on a large reel and is dispensed onto and off of the reel during an operation. The tubing extends from the reel to an injector. The injector moves the tubing into and out of the wellbore. Between the injector and the reel is a tubing guide or gooseneck. The gooseneck is typically attached or affixed to the injector and guides and supports the coiled tubing from the reel into the injector. Typically, the tubing guide is attached to the injector at the point where the tubing enters. As the tubing wraps and unwraps on the reel, it moves from one side of the reel to the other (side-to-side).

Residual bending is one of the technical challenges for coiled tubing operations. Residual bend exists in every coiled tubing string. During storage and transportation, a coiled-tubing string is plastically deformed (bent) as it is spooled on a reel. During operations, the tubing is unspooled (bent) from the reel and bent on the gooseneck before entering into the injector and the wellbore. Although the reel is manufactured in a diameter as large as possible to decrease the residual bending incurred on the coiled tubing, the maximum diameter of many reels is limited to several meters due to storage and transportation restrictions.

As the coiled tubing goes through the injector head, it passes through a straightener; but the tubing retains some residual bending strain. That strain can cause the tubing to wind axially along the wall of the wellbore like a long, stretched spring. In conventional coiled tubing operations, the tubing is translated along the borehole either via gravity or via an injector pushing from the surface. As a result, the end of the coiled tubing being translated into the borehole is load-free. For an extended reach horizontal wellbore, an axial compressive load will build up along the length of the coiled tubing due to frictional interactions between the coiled tubing and the borehole wall. As the borehole "dog-legs" away from the vertical direction, the axial load changes in a tensile direction. A typical axial load as a function of measured depth in a wellbore is plotted in FIG. 1 where the wellbore has a 4000 foot vertical section; a 600 foot, 15 degree per 100 foot dogleg section from vertical to horizontal; and a horizontal section that extends to the end of the wellbore.

When a long length of coiled tubing is deployed in the horizontal portion of the well bore, frictional forces are exerted on the tubing string from the wellbore wall rubbing on the coiled tubing, increasing the axial compressive load. If the horizontal section of the wellbore is sufficiently long, the axial compressive load will be large enough to cause the coiled tubing to buckle. A first buckling mode of the tubing string is referred to as "sinusoidal buckling". In the first buckling mode, the coiled tubing snakes along the bottom of the borehole with curvature in alternating senses. This is a fairly benign buckling mode, in the sense that neither the internal stresses nor frictional loads increase significantly.

A second buckling mode is termed "helical buckling". The helical buckling mode is characterized by the coiled tubing spiraling or wrapping along the borehole wall. Helical buckling can have quite severe consequences. For example, once the coiled tubing begins to buckle helically, the normal force exerted by the borehole wall on the coiled tubing string increases very quickly. This causes a proportional increase in frictional loading, which consequently creates an increase in axial compressive load in the tubing string between the injector and the end of the helically buckled region. Once helical buckling has been initiated, further injection of the tubing causes that axial compressive load to increase sharply with injection to a level that indicates that the tubing string is in a condition termed "lock-up". Visually, the lock-up condition can be noted at the top of the wellbore when the tubing string contacts the wall of the wellbore or well casing. A plot of axial load as a function of measured depth for a coiled tubing, which is almost in a locked up state is shown in FIG. 2. Such lock-up limits the use of coiled tubing as a conveyance member for logging tools in highly-deviated, horizontal, or up-hill sections of wellbores.

Various methods are available to avoid lock-up and extend the reach of coiled tubing. Some of these methods include tractors, tapered coiled tubing strings, alternate materials e.g. composite coiled tubing, straighteners, friction reducers, and injecting a light fluid inside the coiled tubing. These methods are aimed at delaying the onset of helical buckling, which, as described above, may lead to lock-up of the coiled tubing string.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One strategy to delay or avoid lock-up of coiled tubing (hereinafter referred to as "tubing string") that is being introduced into a wellbore is to induce vibration in the tubing string. Several different types of induced vibration are possible, which can be used separately or in combination with each other. These types include:

1) Axial vibration—vibration is induced along the axis of the coiled tubing/wellbore;
2) Lateral vibration—vibration is induced orthogonal to the axis of the coiled tubing/wellbore;
3) Torsional—rotational vibration is induced about the axis of the coiled tubing/wellbore; and
4) Lateral rotational—rotational vibration is induced about an axis orthogonal to the axis of the coiled tubing/wellbore.

According to one aspect, a method is provided for extending reach of a coiled tubing string in a deviated wellbore. The method includes vibrating the tubing string while the tubing string is injected into the wellbore at a first injection speed, finding the peak speed of lateral vibration of the tubing string, determining a second injection speed as a function of the peak speed of lateral vibration, and adjusting the injection speed of the vibrating tubing string from the first injection speed to the determined second injection speed if the first injection speed is not equal to the second injection speed.

BRIEF DESCRIPTION OF THE DRAWINGS

FIG. 4 shows a plot of normalized injection speed versus normalized helix initiation for a simulation of tubing strings that are vibrating at various frequencies;

DETAILED DESCRIPTION

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show details in more detail than is necessary, the description taken with the drawings making apparent to those skilled in the art how the several forms of the subject disclosure may be embodied in practice. Furthermore, like reference numbers and designations in the various drawings indicate like elements.

Helical buckling can limit the extent of reach in extended reach coiled tubing operations. One strategy to delay or avoid lock-up of coiled tubing (hereinafter referred to as "tubing string") that is being introduced into a wellbore is to inject the tubing string at a rate that is based in part on the peak speed of the lateral vibration of the tubing string in the wellbore.

Vibration of a tubing string can be induced by vibration sources (e.g., apparatuses) that may be located in one or several locations along the length of the tubing string. For example, one location for a vibration source may be at the surface (e.g., at the injector head). Also, for example, a vibration source may be located at or near the free end of the tubing string (e.g., at an element of the bottom hole assembly, such as a tractor, etc.). Additionally, for example, one or more vibration sources may be distributed along the length of the tubing string between its free end in the wellbore and its constrained end at the injector at the surface. The latter example may be accomplished by assembling one or more vibration sources to the coiled tubing during its manufacture or assembling one or more vibration sources onto discrete lengths of the coiled tubing such as at joints of such sections (i.e., connectors joining the discrete lengths may house the vibration sources).

Figure 1:
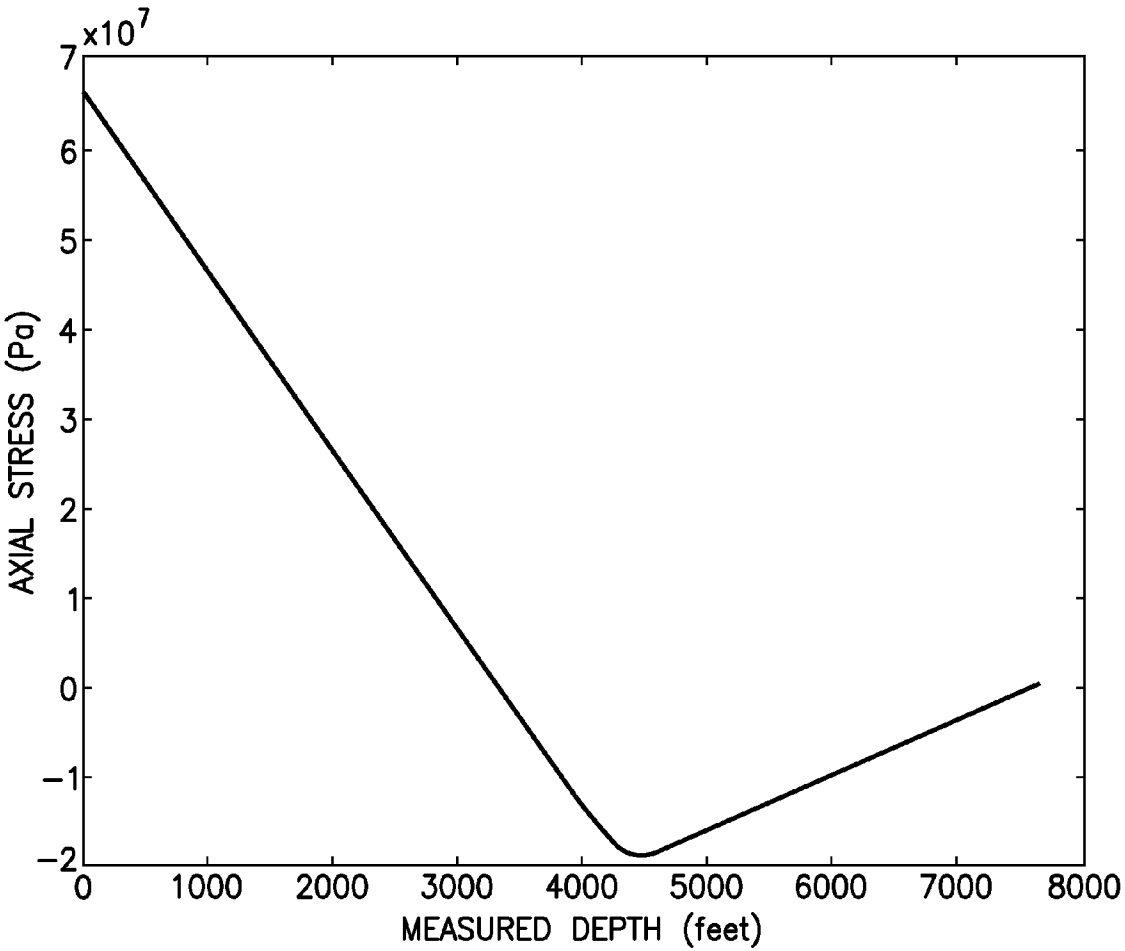
FIG. 1 shows a plot of axial load as a function of measured depth for a tubing string introduced into a cylindrical constraint.
Figure 2:
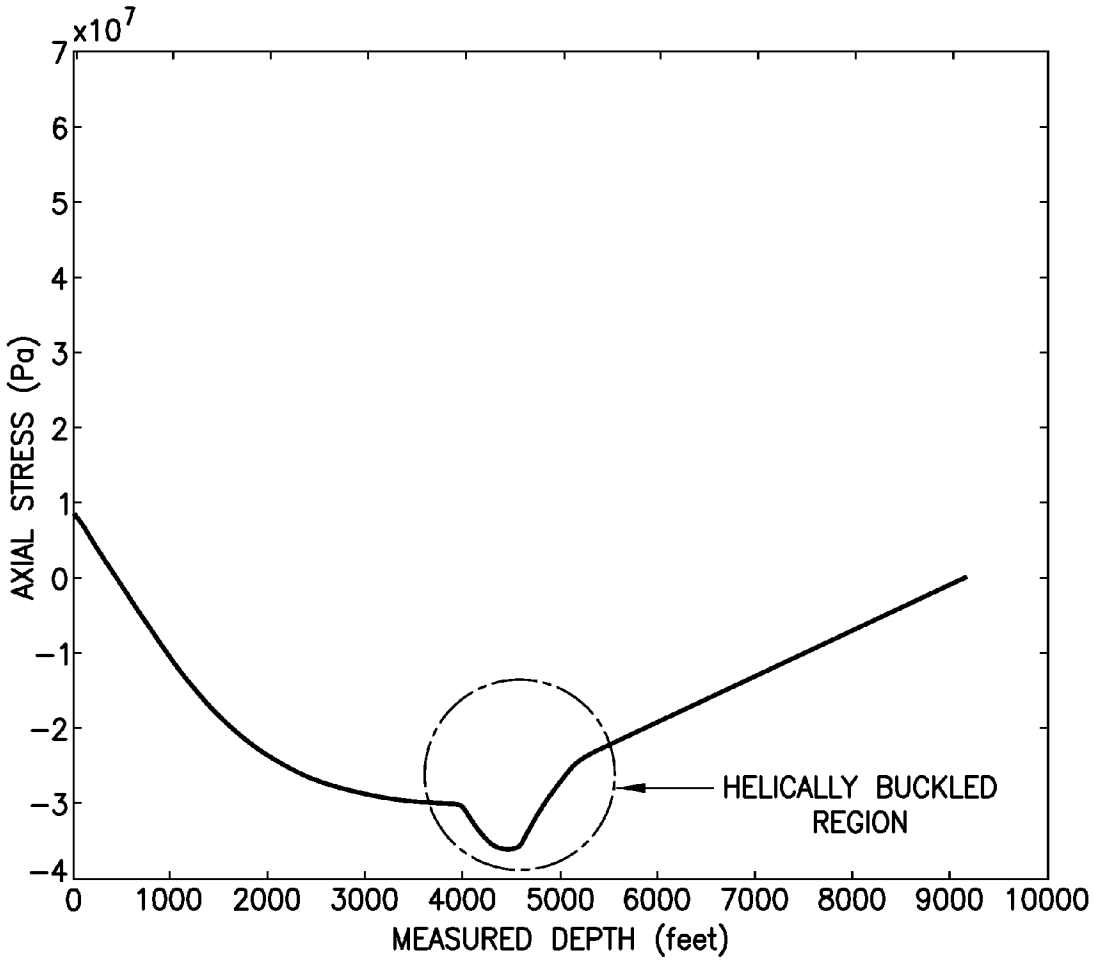
FIG. 2 shows a plot of axial load as a function of measured depth for a coiled tubing string that is almost in a locked up condition.

Helix initiation length is defined as the length of tubing between its free end and the position on the tubing where helical buckling is initiated. For example, the data shown in FIG. 2 relates to a tubing string that is almost in a locked up state, and shows that the ultimate depth near lockup is about 9000 ft and the measured depth at the start of helical buckling is about 4500 ft, resulting in an approximate helix initiation length of about 4500 ft.

Normalized helix initiation is defined as the helix initiation length when the tubing string is vibrated divided by the helix initiation length of the tubing string without being vibrated. Thus, a normalized helix initiation that is greater than 1 indicates that the vibration of the tubing string results in reach extension of the tubing string (i.e., a longer ultimate length at lock-up) beyond what would be possible without vibration of the tubing string. Thus, the larger the normalized helix initiation, the greater the benefit of the vibration. With the foregoing in mind, it is possible to determine a tubing injection speed that will maximize the normalized helix initiation and, therefore, the reach extension of a tubing string.

Because lock-up occurs quickly after the onset of the helical buckling mode, it is possible to use helix initiation length as a proxy for determining the length of the tubing string at which lock-up will occur (lock-up length). That is, because helical initiation length and lock-up length are very highly correlated, the lock-up length can be approximated based on the helical initiation length. Consequently, if the onset of helical buckling can be delayed, lock-up can also be delayed.

In one embodiment coiled tubing that is subject to induced vibration is injected into a deviated wellbore at a speed (hereinafter referred to as $v_{inj}$) that is less than the peak speed of the lateral vibration of the tubing string (hereinafter referred to as $v_{pk}$). The peak speed of the lateral vibration of the tubing string may be obtained using data from an accelerometer mounted on the vibrating portion of the tubing string. Such accelerometer data can be converted into velocity by integrating the acceleration, as is known. When the tubing string is injected at a speed that is less than the peak speed of lateral vibration of the tubing string (i.e., a normalized injection speed $v_{inj}/v_{pk}$ that is less than 1), the induced vibration in the tubing string destabilizes the frictional interaction between the tubing string and the wellbore, allowing for the sinusoidally buckled region (e.g., FIG. 2) to decay away.

Figure 3:
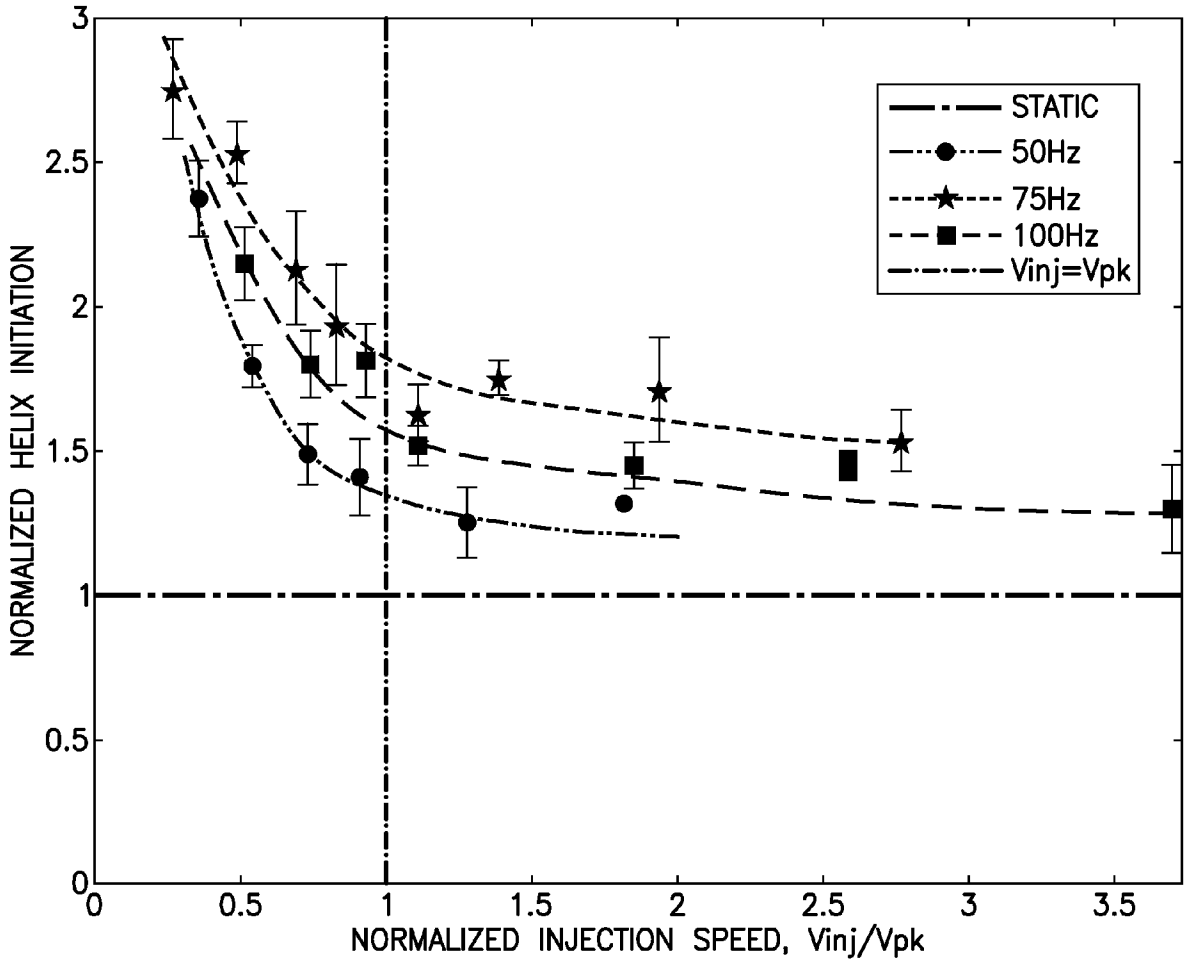
FIG. 3 shows a plot of normalized injection speed versus normalized helix initiation for tubing strings that are vibrating at various frequencies.

FIG. 3 illustrates a plot of normalized helical buckle initiation as a function of normalized injection speed (i.e., $v_{inj}/v_{pk}$) for a tubing string vibrated at three different vibration frequencies in a cylindrical constraint (e.g., a pipe or well bore). As seen in FIG. 3, as the normalized injection speed decreases the normalized helical initiation increases, indicating that reach extension increases substantially. Indeed, as the injection speed decreases toward zero, the high-friction sinusoidally buckled region has greater time to relax and decay away, allowing for relatively farther reach.

FIG. 4 illustrates normalized helical buckle initiation data as a function of normalized injection speed for a simulation of a tubing string vibrated at three different vibration frequencies in a cylindrical constraint (e.g., a pipe or well bore). The simulation models, among other factors, the frictional forces between the tubing string and the wellbore that arise when the tubing string is pushed along the horizontal section of the deviated well bore. In FIG. 4, the simulated data is plotted for vibrations in the frequency range of 5 to 1000 Hz. In some cases, (the open square, the solid circle and the open triangle) the frequency and the injection speed were fixed and the peak acceleration was changed to obtain multiple points on the plot. In another case, (the X), the frequency and peak acceleration were fixed and the injection speed was changed to obtain multiple points on the plot. In other cases, (the open star and the closed star) the peak acceleration and the injection speed were fixed and the vibration frequency was changed in order to obtain multiple points on the plot. And, in another case (the open circle), the peak acceleration was fixed and the injection speed and vibration frequency were changed in order to obtain points on the plot. As shown in FIG. 3, as injection speed decreases, the helical buckling initiation length increases. Also, FIG. 4 shows that for all of the frequencies, as the normalized injection speed approaches 4 (i.e., the injection speed is four times as large as the lateral velocity of the tubing string) there will be little reach extension when compared to tubing strings that are not vibrated.

The data in FIGS. 3 and 4 show that for normalized injection speeds less than one, as the injection speed approaches 0, reach can increase more than two-fold. In one aspect, as is seen from FIGS. 3 and 4, a normalized injection speed less than or equal to 1 is advantageous as the normalized helix initiation rises significantly as the normalized injection speed reduces below unity. In another aspect, normalized injection speeds of less than or equal to 0.8, 0.6, 0.5, 0.4, and 0.3 are useful in increasing reach. However, there are practical considerations of injecting the tubing string too slowly that militate against very low injection speeds (e.g., normalized injection speeds less than 0.25). For example, low injection speeds mean that the duration and cost of installing the tubing increase.

During an actual job, real-time actions can be taken to change the injection speed to achieve the maximum reach, taking into account the foregoing discussion.

Figure 5:
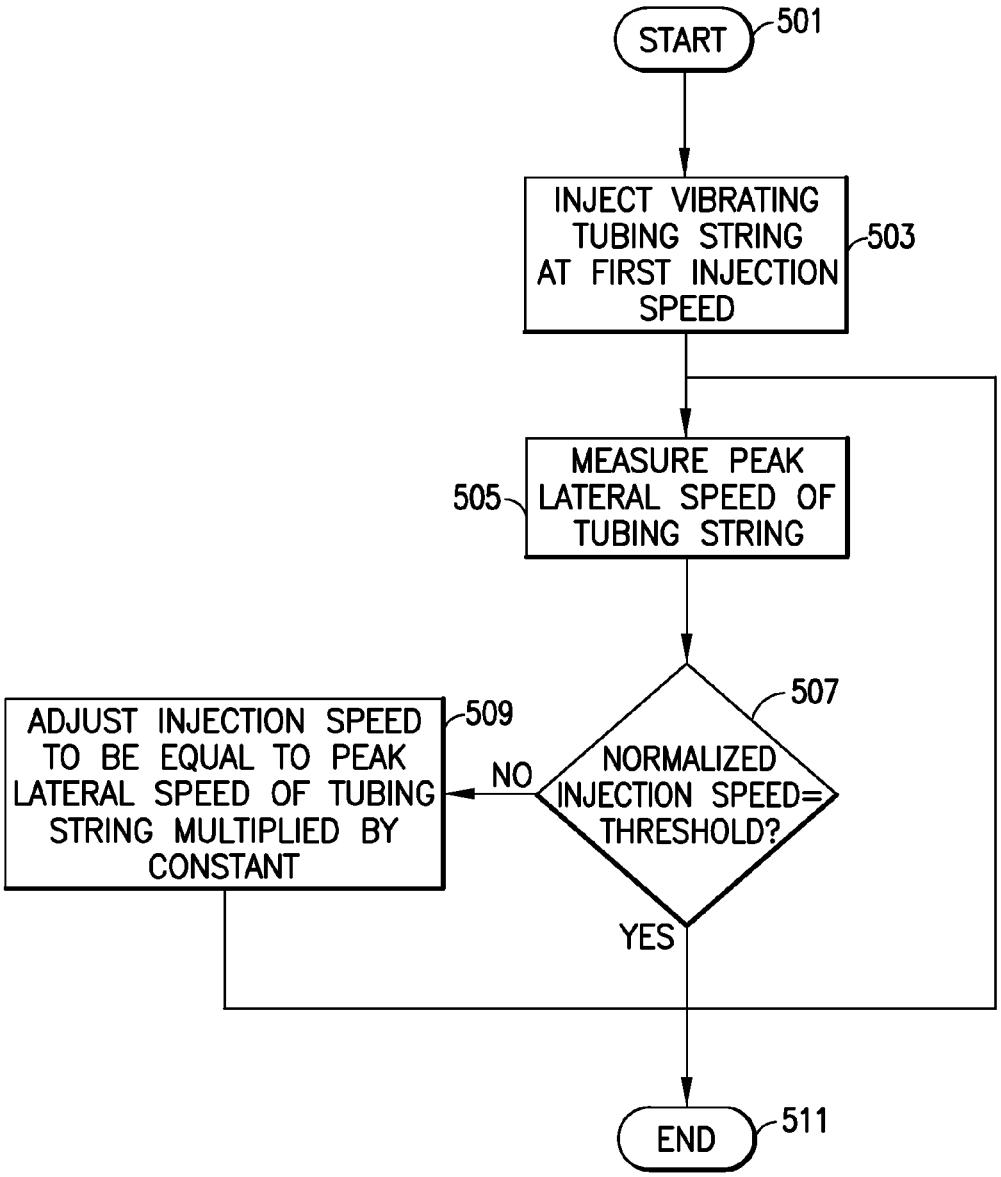
FIG. 5 shows an embodiment of a workflow for extending reach in a deviated wellbore.

FIG. 5 shows a workflow to extend reach in a wellbore. At 501 the workflow starts with the coiled tubing string being arranged at the top of a wellbore and readied for injection into the wellbore. At 503 the tubing is injected into the wellbore while vibration is induced in the tubing string at a frequency. At 505 the peak lateral speed of the vibrating tubing string is measured. At 507 the normalized injection speed is determined and compared to a constant (e.g., a threshold value) that is less than 1 (e.g., 0.5) to determine whether the injection speed should be adjusted to achieve a desired reach extension associated with the constant (e.g., threshold value). For example, if it is determined at 507 that the normalized injection speed is not equal to the constant (e.g., 0.5) (NO at 507), then the injection speed is adjusted at 509 to achieve the desired normalized injection speed. On the other hand, if the normalized injection speed is equal to the constant (e.g., minimum threshold) (YES at 507), then the injection speed is not adjusted and the injection continues at that injection speed until either lock-up approaches or the tubing string reaches the end of the wellbore at 511.

In one embodiment, as suggested by the loop between the output of 507 or 509 and the input to 505 in FIG. 5, the peak vibration speed may be monitored during injection, and changes in peak vibration speed may be used to change the injection speed.

In one embodiment, as the tubing string approaches lock-up, the injection speed may be modified (e.g., decreased) further in an attempt to obtain farther reach of the tubing string in the deviated wellbore.

The workflow described above may employ the use of sensors (downhole and/or at surface) to monitor the injection speed of the tubing and the velocity of the lateral movement of the tubing string, which would allow for feedback on the effect of adjusting the injection speed. This information could be processed and used downhole, or it could be transmitted to the surface (for example, via fiber optic cable, wirelessly, via electrical cable, or via other means). In this way, the information can be used to optimize the performance of the injection and vibration equipment to achieve maximum reach extension of the tubing string in the deviated wellbore.

In one aspect, some of the methods and processes described above, such as the workflow described with respect to FIG. 5, are performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above. The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Figure 6:
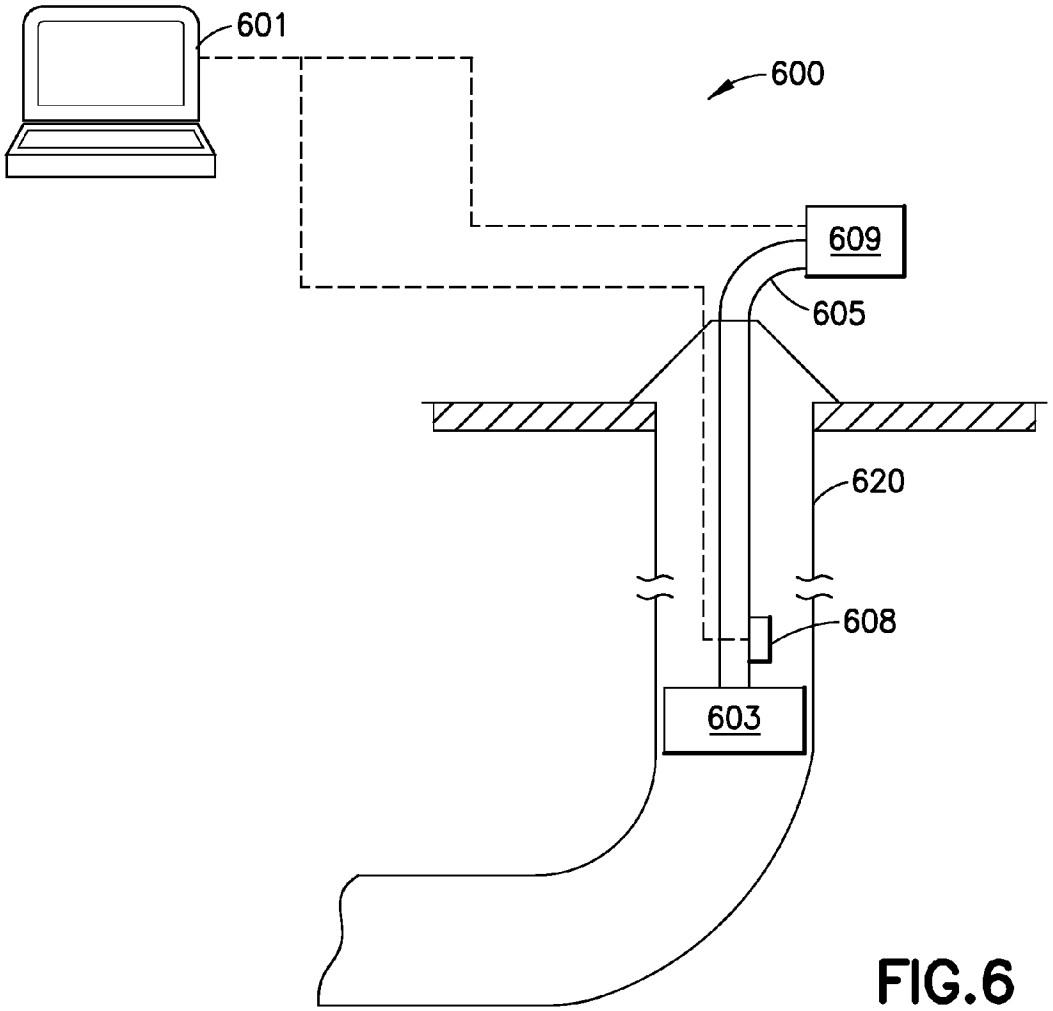
FIG. 6 shows an embodiment of a system for extending reach in a deviated wellbore.

FIG. 6 shows an example of a system 600 for extending reach of a coiled tubing string in a deviated wellbore. The system 600 includes a computer system or processor 601, a vibration source 603, a tubing string 605 which is vibrated by the vibration source 603, one or more sensors (accelerometers) 608 coupled to or attached to the tubing string 605, and an injector 609 coupled to the tubing string for injecting the tubing string into a wellbore 620. In one embodiment, the processor 601 may include a system described above. In one embodiment, the computer system includes a computer processor (e.g., a microprocessor, microcontroller, digital signal processor, or general purpose computer) for executing the workflow described herein, such as the workflow shown in FIG. 5. In one embodiment, the processor 601 is communicatively coupled to a vibration source 603. In one embodiment, the processor 601 also communicates via a wired or wireless connection with the sensor 608 and with the injector 609 at the top of the wellbore 620. The processor 601 determines an injection speed for injecting the tubing string 605 into the wellbore 620 and outputs an injection speed control signal based on the determined injection speed. The injector 609 is constructed to inject the tubing string 605 at the injection speed based on the injection speed control signal.

The vibration source 603 is constructed to vibrate the tubing string 605. The vibration source 603 may be capable of inducing one or more different types of vibration. Also, the different types of induced vibration can be employed separately or in combination with each other. The types of vibration may include axial vibration where vibration is induced along the axis of the coiled tubing/wellbore, lateral vibration where vibration is induced orthogonal to the axis of the coiled tubing/wellbore, torsional-rotational vibration where vibration is induced about the axis of the coiled tubing/wellbore, and lateral rotational-rotational vibration where vibration is induced about an axis orthogonal to the axis of the coiled tubing/wellbore.

Vibration of a tubing string can be induced by one or more vibration sources 603 (e.g., apparatuses) that may be located in one or several locations along the length of the tubing string 605. For example, one location for the vibration source 603 may be at the surface (e.g., at the injector head). Also, for example, the vibration source 603 may be located at or near the free end of the tubing string 605 (e.g., at an element of the bottom hole assembly, such as a tractor, etc.). Additionally, for example, one or more vibration sources 603 may be distributed along the length of the tubing string 605 between its free end in the wellbore 620 and its constrained end at the injector 609 at the surface. The latter example may be accomplished by assembling one or more vibration sources 603 to the coiled tubing 605 during its manufacture or assembling one or more vibration sources 603 onto discrete lengths of the coiled tubing 605 such as at joints of such sections (i.e., connectors joining the discrete lengths may house the vibration sources).

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for extending reach of a coiled tubing string in a deviated wellbore, the method comprising:

vibrating the tubing string while the tubing string is injected into the wellbore at a first injection speed;

obtaining a first peak speed of lateral vibration of the tubing string at the first injection speed;

determining a second injection speed as a function of the obtained peak speed of lateral vibration; and adjusting the injection speed of the vibrating tubing string from the first injection speed to the determined second injection speed.

2. The method according to claim 1, wherein: said second injection speed equals said peak speed multiplied by a constant.

3. The method according to claim 2, wherein: said constant is less than or equal to 1.

4. The method according to claim 2, wherein: said constant is less than or equal to 0.5.

5. The method according to claim 1, wherein: the tubing string is vibrated at a vibration frequency in a range of 5 to 1000 Hz.

6. The method according to claim 5, wherein: the tubing string is vibrated at a vibration frequency in a range of 5 to 100 Hz.

7. The method according to claim 1, further comprising:

obtaining a second peak speed of lateral vibration while the tubing is injected at the second injection speed;

comparing the second peak speed of lateral vibration to the first peak speed of lateral vibration; and adjusting the injection speed of the vibrating tubing string until the second peak speed of lateral vibration is equal to the first peak speed of lateral vibration if the speeds are not equal.

8. A non-transitory computer-readable storage medium storing an executable computer program for causing a computer to execute a method of extending reach of a coiled tubing string in a deviated wellbore, the method comprising:

vibrating the tubing string while the tubing string is injected into the wellbore at a first injection speed;

obtaining the peak speed of lateral vibration of the tubing string at the first injection speed;

determining a second injection speed as a function of the obtained peak speed of lateral vibration; and adjusting the injection speed of the vibrating tubing string from the first injection speed to the determined second injection speed.

9. The method according to claim 8, wherein: said second injection speed equals said peak speed multiplied by a constant.

10. The method according to claim 9, wherein: said constant is less than or equal to 1.

11. The method according to claim 9, wherein: said constant is less than or equal to 0.5.

12. The method according to claim 8, wherein: the tubing string is vibrated at a vibration frequency in a range of 5 to 1000 Hz.

13. The method according to claim 12, wherein: the tubing string is vibrated at a vibration frequency in a range of 5 to 100 Hz.

14. The method according to claim 8, further comprising:

obtaining a second peak speed of lateral vibration while the tubing is injected at the second injection speed;

comparing the second peak speed of lateral vibration to the first peak speed of lateral vibration; and adjusting the injection speed of the vibrating tubing string until the second peak speed of lateral vibration is equal to the first peak speed of lateral vibration determined if the speeds are not equal.

15. A system for extending reach of a coiled tubing string in a deviated wellbore, the system comprising:

a vibrator coupled to and vibrating the tubing string;

a sensor coupled to the coiled tubing string, said sensor providing an indication related to a peak speed of lateral vibration of the tubing string;

a controller coupled to said sensor and adapted to determine an injection speed of the tubing string as a function of an obtained peak speed of lateral vibration of the tubing string and to output an injection speed control signal based on said determined injection speed, wherein the tubing string is induced to vibrate at a frequency in the wellbore; and an injector constructed to inject the coiled tubing at said determined injection speed based at least on said control signal output from said controller.

16. The system according to claim 15, wherein: said controller is constructed to determine said injection speed based on a constant and said obtained peak speed of lateral vibration.

17. The system according to claim 16, wherein: said injection speed equals said peak speed multiplied by said constant.

18. The system according to claim 17, wherein: said constant is less than or equal to 1.

19. The system according to claim 17, wherein: said constant is less than or equal to 0.5.

20. The system according to claim 15, wherein: said vibrator vibrates the tubing string at a vibration frequency in a range of 5 to 1000 Hz.

* * * * *